US011387055B2

(12) United States Patent
Yang et al.

(10) Patent No.: US 11,387,055 B2
(45) Date of Patent: Jul. 12, 2022

(54) CONTROL DEVICE CAPABLE OF PROVIDING ROTATIONAL DAMPING THROUGH MAGNETIC FORCE

(71) Applicants: DONGGUAN SOLIDTEK ELECTRONICS CO., LTD., Dongguan (CN); SOLID YEAR CO., LTD., New Taipei (TW)

(72) Inventors: Tien-Hao Yang, New Taipei (TW); Chi-Feng Liu, New Taipei (TW); Yuan-Zhang Liu, Dongguan (CN)

(73) Assignees: DONGGUAN SOLIDTEK ELECTRONICS CO., LTD., Dongguan (CN); SOLID YEAR CO., LTD., New Taipei (TW)

( * ) Notice: Subject to any disclaimer, the term of this patent is extended or adjusted under 35 U.S.C. 154(b) by 114 days.

(21) Appl. No.: 17/034,970

(22) Filed: Sep. 28, 2020

(65) Prior Publication Data

US 2021/0193407 A1 Jun. 24, 2021

(30) Foreign Application Priority Data

Dec. 18, 2019 (TW) ..... 108216802

(51) Int. Cl.
*H01H 9/54* (2006.01)
*H01F 7/06* (2006.01)

(52) U.S. Cl.
CPC ..... *H01H 9/54* (2013.01); *H01F 7/06* (2013.01)

(58) Field of Classification Search
CPC ..... H01H 9/54; H01H 9/443; H01H 9/548; H01H 3/50; H01H 3/60; H01H 2003/506; H01H 19/11; H01H 25/06; H01F 7/06
USPC ..... 200/33 R, 253, 256, 261.83 N, 34
See application file for complete search history.

(56) References Cited

U.S. PATENT DOCUMENTS

| | | | | |
|---|---|---|---|---|
| 9,183,996 | B2 * | 11/2015 | Karlström | H01H 33/6662 |
| 9,508,514 | B2 * | 11/2016 | Ohda | H01F 7/122 |
| 10,090,126 | B2 * | 10/2018 | Kakio | H01H 33/38 |
| 10,400,841 | B2 * | 9/2019 | Inoue | F16F 15/03 |
| 10,818,454 | B2 * | 10/2020 | Park | H01H 33/42 |
| 2020/0251295 | A1 * | 8/2020 | Ängquist | H01H 3/60 |

* cited by examiner

*Primary Examiner* — William A Bolton
(74) *Attorney, Agent, or Firm* — Muncy, Geissler, Olds & Lowe, P.C.

(57) ABSTRACT

A control device capable of providing rotational damping through a magnetic force is provided directly at the base of an electronic product and includes a supporting member, an adjusting member, and two magnetic members. The supporting member is provided at the base. The adjusting member is rotatably provided on the supporting member. The adjusting member has a bottom portion corresponding to a switch pre-installed in the base. The adjusting member further has a head portion outside the base. The two magnetic members are provided on the supporting member and the adjusting member respectively. The two magnetic members generate a magnetic force therebetween and thereby change the rotational damping between the supporting member and the adjusting member.

6 Claims, 2 Drawing Sheets

CONTROL DEVICE CAPABLE OF PROVIDING ROTATIONAL DAMPING THROUGH MAGNETIC FORCE

BACKGROUND OF THE INVENTION

1. Field of the Invention

The present invention relates to a control device for an electrical switch. More particularly, the invention relates to a control device that provides rotational damping by way of a magnetic force.

2. Description of the Related Art

A switch in an electric circuit is an electrical device that can be used to close the circuit, stop an electric current, or guide the electric current to another circuit. A typical switch includes two contacts that can be brought into contact with and separated from each other repeatedly. When the contacts are in contact, the circuit where the switch is used is closed to allow an electric current to flow through the circuit; when the contacts are not in contact, the circuit is open, so no electric current can flow through the circuit. The switch, therefore, serves to control the circuit.

To control and adjust circuit signals more precisely, a switch can be added with a control device that provides rotational damping so that fine-tunable and variable control over the switch can be achieved by operating and adjusting the control device.

However, as the control device capable of providing rotational damping is generally integrated into the switch, mounting the switch on the housing or other component of a mechanism may present problems: tolerance stack-up between the circuit board of the switch and the mechanism may lead to positional deviation or misalignment during assembly such that extra working hours are required for putting the aforesaid components together, which makes it impossible to lower production cost or better the quality of the manufacturing process and of the finished product.

SUMMARY OF THE INVENTION

The primary objective of the present invention is to offer a control device that provides magnetic force-based rotational damping, thereby preventing assembly problems associated with positional deviation, reducing the time and cost of manufacture, and enhancing the quality of the finished product as well as the manufacturing process.

To achieve the objective stated above, the present invention discloses a control device that provides rotational damping through a magnetic force. The control device is provided at a base, and the base is provided therein with a switch. The control device includes a supporting member, an adjusting member, and two magnetic members. The supporting member is provided at the base. The adjusting member is rotatably provided on the supporting member. The adjusting member has a bottom portion corresponding to the switch. The adjusting member has a head portion outside the base. The two magnetic members are provided on the supporting member and the adjusting member respectively. The two magnetic members generate a magnetic force therebetween and thereby change the rotational damping between the supporting member and the adjusting member.

Preferably, the adjusting member includes a rotating shaft, and the rotating shaft is rotatably provided in the supporting member.

Preferably, the supporting member has a guiding portion, the rotating shaft is provided in the guiding portion, and the rotating shaft has a bottom portion corresponding to the switch.

Preferably, a first one of the two magnetic members is provided on the supporting member, and a second one of the two magnetic members is provided on the head portion of the adjusting member at a position adjacent to the first magnetic member.

Preferably, the head portion of the adjusting member includes a driving member and a cover covering the driving member.

The detailed structure or features provided by the present invention will be described in the detailed description of the subsequent implementation. As a person of ordinary skill in the art would understand, the detailed description and the specific embodiments provided herein serve only to expound the invention and are not intended to limit the scope of the patent protection sought by the applicant.

DETAILED DESCRIPTION OF THE INVENTION

The technical contents and features of the present invention are detailed below with reference to some preferred embodiments in conjunction with the accompanying drawings. The invention can be applied to switches and electronic products of various forms and specifications. As a person of ordinary skill in the art would understand, the terminology used in this section of the specification includes superordinate terms, whose application fields are subject to no limitations. For example, a term that is used to specify a material or shape refers to but is not limited to the material or shape specified. The same applies to such positional terms as "provided", "near", "connected to", and "adjacent to". The indefinite article "a" may connote plurality as well as singularity in terms of the quantity of a component. Directional terms such as "upper", "lower" "inner", "outer", "top", and "bottom" make reference to directions in normal use and serve illustrative purposes only; they are not intended to be restrictive of the scope of the invention.

Figure 1:
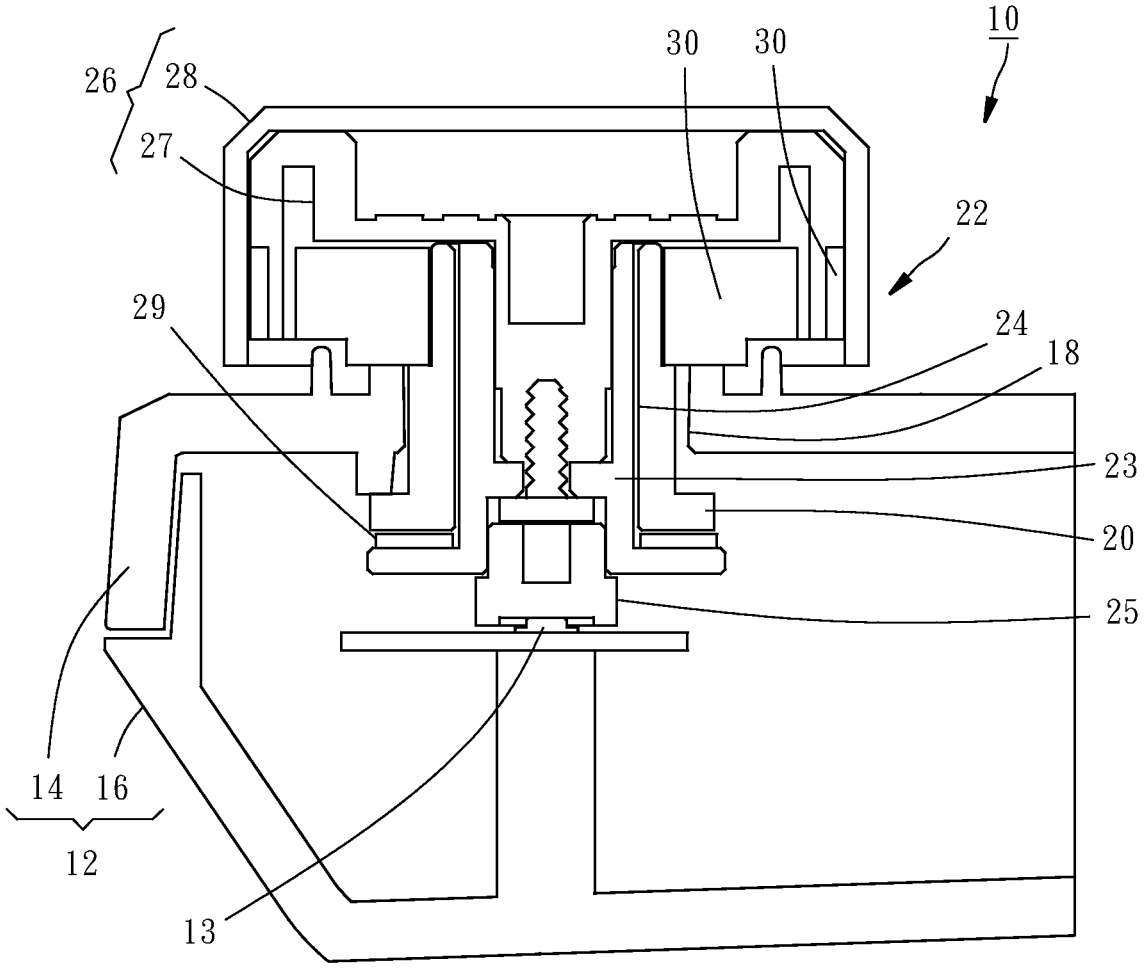
FIG. 1 schematically shows a preferred embodiment of the present invention.

Referring to FIG. 1, a control device 10 capable of providing rotational damping through a magnetic force according to the present invention is provided at the base 12 of an electronic product by way of example. The base 12 can be divided into an upper cover 14 and a lower cover 16, with a switch 13 provided in the base 12 in advance and located on the lower cover 16. The upper cover 14 is provided with a positioning portion 18 corresponding in position to the switch 13, and the positioning portion 18 in this preferred embodiment is an open hole by way of example.

The control device 10 includes a supporting member 20, an adjusting member 22, and two magnetic members 30. The supporting member 20 extends through the positioning portion 18 of the base 12. The supporting member 20 has a guiding portion 24, and the guiding portion 24 in this preferred embodiment is a through hole penetrating the supporting member 20 by way of example.

The adjusting member 22 in this preferred embodiment includes a rotating shaft 23. The rotating shaft 23 extends through the guiding portion 24 of the supporting member 20 such that the adjusting member 22 is provided on the supporting member 20 in a rotatable manner. The rotating shaft 23 has a bottom portion 25 corresponding to the switch 13. A washer 29 is provided as an intermediate element between the bottom portion 25 and the supporting member 20. The adjusting member 22 has ahead portion 26 provided at the top end of the rotating shaft 23 and located outside the upper cover 14 of the base 12. The head portion 26 includes a driving member 27 joined to the rotating shaft 23 and a cover 28 covering the driving member 27. The cover 28 may be made of metal or in a way that produces the desired appearance.

The two magnetic members 30 are provided on the supporting member 20 and the adjusting member 22 respectively. In this preferred embodiment, the two magnetic members 30 are both permanent magnets by way of example. One of the magnetic members 30 is provided around a top outer peripheral portion of the supporting member 20 while the other magnetic member 30 is provided on the head portion 26 of the adjusting member 22, or more particularly at a position between the inner periphery of the cover 28 and the driving member 27 and adjacent to the magnetic member 30 on the supporting member 20, such that the two magnetic members 30 can generate a magnetic force therebetween and, when the adjusting member 22 is rotated with respect to the supporting member 20, subject the adjusting member 22 to magnetic attraction and hence increased resistance during rotation.

As the control device 10 is provided independently at the upper cover 14 of the base 12, it is feasible to mount the control device 10 directly on the upper cover 14 in advance, without the adjusting member 22 of the control device deviating in position or shifted in place. After that, the upper cover 14 and the lower cover 16 are put together to complete the assembly, allowing the switch 13 to be controlled with the adjusting member 22. Compared with the prior art, the control device 10 can be made in a shorter time, at a lower cost, and with higher finished product quality as well as higher manufacturing process quality. In addition, the magnetic force between the two magnetic members 30 can increase or change the torsion of the adjusting member 22 while the adjusting member 22 is rotated, thereby rendering the switch 30 into a fine-tunable and variable switch.

The two magnetic members 30 may be implemented differently according to practical needs. For example, one of the magnetic members 30 may be made of a material with magnetic permeability, such as iron, while the other magnetic member 30 is a permanent magnet. It is also feasible for the adjusting member 22 to be capable of vertical linear displacement with respect to the supporting member 20 in order to press and thereby trigger the switch 13 directly.

Figure 2:
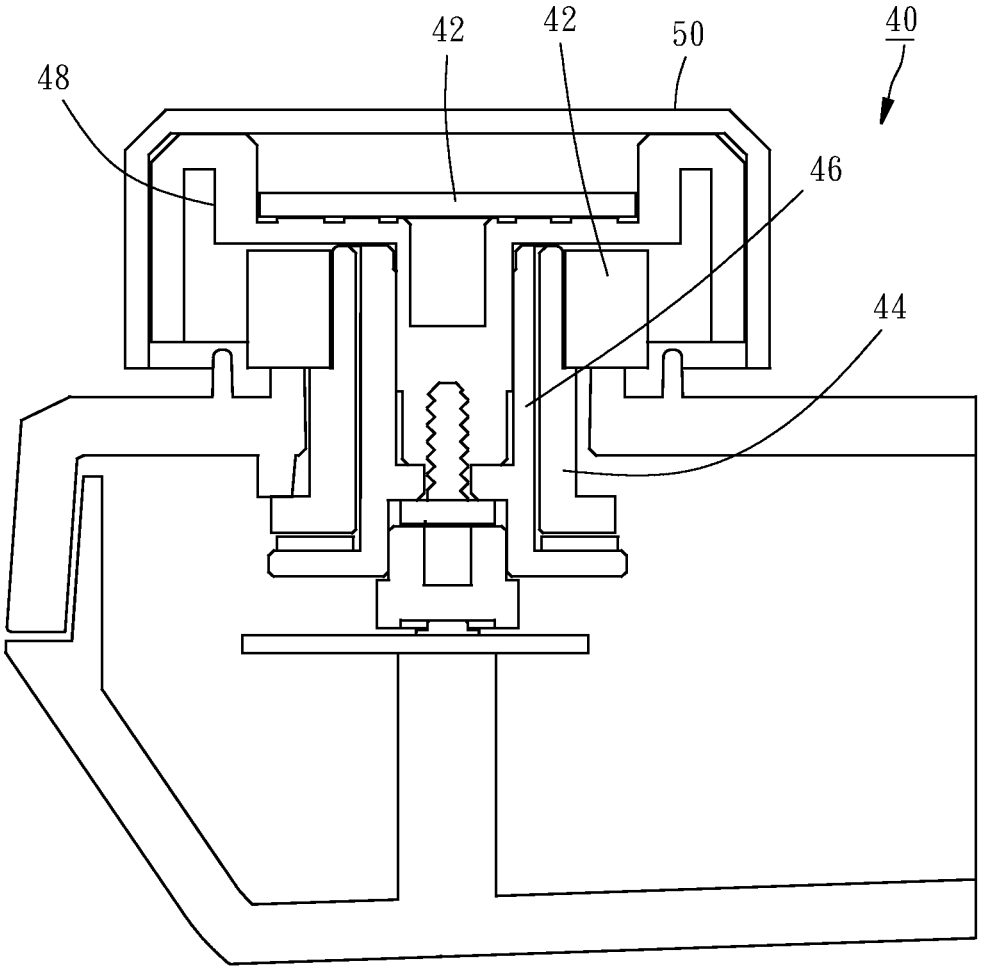
FIG. 2 schematically shows another preferred embodiment of the present invention.

FIG. 2 shows the control device 40 capable of providing rotational damping through a magnetic force according to another preferred embodiment of the present invention. This embodiment has generally the same elements as the previous embodiment and is different from the previous embodiment in that, although one of the magnetic members 42 is still provided around a top outer peripheral portion of the supporting member 44, the other magnetic member 42 is provided between a top portion of the driving member 48 of the adjusting member 46 and the cover 50 of the adjusting member 46 and is adjacent to the magnetic member 42 on the supporting member 44. The two magnetic members 42 are equally capable of generating a magnetic force therebetween and achieving the objective of the invention.

What is claimed is:

1. A control device capable of providing rotational damping through a magnetic force, wherein the control device is provided at a base, and the base is provided therein with a switch, the control device comprising:

a supporting member provided at the base;

an adjusting member rotatably provided on the supporting member, wherein the adjusting member has a bottom portion corresponding to the switch, and the adjusting member has a head portion outside the base; and two magnetic members provided on the supporting member and the adjusting member respectively, wherein the two magnetic members generate a magnetic force therebetween and thereby change rotational damping between the supporting member and the adjusting member.

2. The control device capable of providing rotational damping through a magnetic force as claimed in claim 1, wherein the adjusting member comprises a rotating shaft, and the rotating shaft is rotatably provided in the supporting member.

3. The control device capable of providing rotational damping through a magnetic force as claimed in claim 2, wherein the supporting member has a guiding portion, the rotating shaft is provided in the guiding portion, and the rotating shaft has a bottom portion corresponding to the switch.

4. The control device capable of providing rotational damping through a magnetic force as claimed in claim 1, wherein a first one of the two magnetic members is provided on the supporting member, and a second one of the two magnetic members is provided on the head portion of the adjusting member at a position adjacent to the first magnetic member.

5. The control device capable of providing rotational damping through a magnetic force as claimed in claim 1, wherein the head portion of the adjusting member comprises a driving member and a cover covering the driving member.

6. The control device capable of providing rotational damping through a magnetic force as claimed in claim 1, wherein the adjusting member comprises a rotating shaft, the rotating shaft has a bottom portion, and a washer is provided between the bottom portion of the rotating shaft and the supporting member.

* * * * *